US007131911B2

(12) United States Patent
Kim

(10) Patent No.: US 7,131,911 B2
(45) Date of Patent: Nov. 7, 2006

(54) SLOPE CONTROLLABLE FOOT PLATE FOR GOLF SWING PRACTICE APPARATUS

(75) Inventor: Wonil Kim, Seoul (KR)

(73) Assignee: Golfzon Co. Ltd, Daejon (KR)

( * ) Notice: Subject to any disclaimer, the term of this patent is extended or adjusted under 35 U.S.C. 154(b) by 65 days.

(21) Appl. No.: 10/513,395

(22) PCT Filed: Feb. 27, 2004

(86) PCT No.: PCT/KR2004/000428

§ 371 (c)(1),
(2), (4) Date: Nov. 4, 2004

(87) PCT Pub. No.: WO2004/087267

PCT Pub. Date: Oct. 14, 2004

(65) Prior Publication Data

US 2005/0153787 A1 Jul. 14, 2005

(30) Foreign Application Priority Data

Apr. 1, 2003 (KR) ..... 10-2003-00200390

(51) Int. Cl.
*A63B 69/36* (2006.01)
*A47F 5/02* (2006.01)
*F16M 13/00* (2006.01)

(52) U.S. Cl. ..... 473/279; 473/161; 108/7; 248/396

(58) Field of Classification Search ..... 473/278, 473/279, 160, 161; 108/7; 348/394, 396
See application file for complete search history.

(56) References Cited

U.S. PATENT DOCUMENTS 2,269,786 A * 1/1942 Rose ..... 187/274
3,229,941 A * 1/1966 Menahem et al. ..... 248/163.1
3,288,421 A * 11/1966 Peterson ..... 248/396
4,374,497 A * 2/1983 Harmand ..... 108/4
5,340,111 A * 8/1994 Froelich ..... 473/279
5,460,379 A * 10/1995 Cleland ..... 473/279
5,470,074 A * 11/1995 Hotchkiss et al. ..... 473/279
5,527,042 A * 6/1996 Spriddle ..... 473/279
5,632,689 A * 5/1997 Duca ..... 473/279
5,683,306 A * 11/1997 Tait et al. ..... 473/279
5,820,478 A * 10/1998 Wood et al. ..... 473/279
5,944,615 A 8/1999 Lee
6,161,809 A * 12/2000 Mahy et al. ..... 248/396
6,179,724 B1 1/2001 Yang
6,352,018 B1 * 3/2002 Krisher ..... 92/130 R
6,659,881 B1 * 12/2003 Lee ..... 473/279
6,663,498 B1 * 12/2003 Stipan ..... 473/279
2002/0128084 A1 * 9/2002 Lee et al. ..... 473/132

FOREIGN PATENT DOCUMENTS

KR 2000-0067718 A 11/2000
KR 306597 Y 2/2003

* cited by examiner

*Primary Examiner*—Mark S. Graham
(74) *Attorney, Agent, or Firm*—Birch, Stewart, Kolasch & Birch, LLP

(57) ABSTRACT

A slope controllable foot plate for a golf swing practice apparatus which includes a actuating oil pressure motor providing the power for controlling the slope, a transformation device for transforming the rotating driving power to linear driving power, and a slope control oil pressure cylinder for controlling the slope of the foot plate, whereby a lower height and a simplified structure of the foot plate is obtained.

10 Claims, 4 Drawing Sheets

SLOPE CONTROLLABLE FOOT PLATE FOR GOLF SWING PRACTICE APPARATUS

TECHNICAL FIELD

The present invention relates to a foot plate for a golf swing practice apparatus, which can be controlled to be sloped in all directions so that a golfer can practice his/her golf swing on an inclined surface as well as a flat surface.

BACKGROUND ART

Generally, golf is a game in which a ball is hit by golf clubs into holes spread over a location with uneven topography. Since golf courses are mainly constructed at places with uneven topography such as at the base of mountains, considerable expertise is required for the golf club swing. Therefore, prior to playing a round of golf at golf courses, a golfer should practice golf while correcting his/her golf swing or posture at an indoor golf range in order to achieve a good golf swing. At this time, the gofer swing draws a circle and should be performed by stereoscopic motions in which motions of the upper and lower parts of the body, motions of knees, and timing are perfected in connection with a proper grip and a proper address position. The practice is performed with a driver, a short iron, a middle iron, a long iron, and the like. The practice of the golf swing should be done with the correct posture for all swing shots.

However, since a golfer generally practices golf only at flat locations, e.g. in a conventional indoor golf range, he/she cannot sufficiently and satisfactorily practice golf for the purpose of making preparation for actual golf games in which there are various changes in topography such as inclined locations on golf courses. Therefore, a golfer cannot do himself/herself justice in practicing for an actual golf game.

To solve such a problem and to ensure practice simulating an actual golf game, there has been developed a foot plate for a golf swing practice apparatus, in which the slope of the foot plate can be controlled both in a right and left directions and in the fore and aft directions.

For example, Korean Patent No. 10-0358416 discloses a slope control apparatus for a golf swing practice mat, in which a hydraulic cylinder is lifted and lowered by means of a control panel and an oil unit and a lower support plate is connected to an upper slope control plate.

Further, Korean Patent Laid-Open Publication No. 2002-0044130 discloses a slope controllable hitting-zone foot plate for golf practice, in which four supports with spherical recess portions formed therein are fixedly installed on the bottom of the hitting-zone foot plate and hemispherical piston heads that are in point contact with the spherical recess portions of the respective supports are fixedly installed at the distal ends of pistons of four hydraulic jacks controlled by a control unit so as to support the hitting-zone foot plate, thereby controlling the hitting-zone foot plate in various slope directions and at various angles.

Moreover, Korean Utility Model Registration No. 20-0267916 discloses a slope adjusting apparatus for a golf hitting-zone, which comprises an address foot plate including first and second panels pivotably installed through a pivot member; a bottom plate including a gear shaft formed integrally therewith on a constant level at the center thereof and with a first gear portion at one end of the gear shaft, ball bearings equidistantly installed at a predetermined interval with respect to the gear shaft, and ball insertion portions for receiving the ball bearings; a slope adjustor including a driving motor installed to abut against the ball bearings mounted on the bottom plate and having a second gear engaged with the first gear, a first lifting means installed adjacent to the driving motor to adjust the level of the second plate, and an intermediate plate having a fixing portion installed at a position corresponding to the first lifting means to fix the first plate; a golf ball receiving unit having second and third lifting means of which levels are adjusted according to slope changes by the slope adjustor; and a control unit for powering and controlling the driving motor and the first to third lifting means.

Furthermore, Korean Utility Model Registration No. 20-0175850 discloses a slope controllable foot plate for golf practice, in which cylinders are attached to respective corners of top and bottom plates, two pairs of diagonally opposing cylinders are connected through respective hoses to each other so as to communicate with each other, valves are attached to intermediate portions of the hoses, and the valves can be simultaneously opened and closed by a lever exposed upwardly beyond the top plate.

In such a conventional foot plate for a golf swing practice apparatus, the slope of the foot plate can be controlled by means of a fully hydraulic or mechanical type slope control device of the foot plate. However, the fully hydraulic type device has a problem in that production costs are increased, while the fully mechanical type device has problems in that the load is transmitted directly to mechanical parts due to play existing in the mechanical parts themselves when a golfer stands on the foot plate and practices golf, resulting in damage to the motor. Also, a golf club may come into contact with a ceiling of an indoor golf range due to the increased level of the foot plate.

DISCLOSURE OF INVENTION

The present invention is conceived to solve the aforementioned problems. The present invention is to reduce production costs and simultaneously to solve the problems with a fully mechanical type device by constructing a semi-hydraulic and semi-mechanical type device using a hydraulic cylinder and a hydraulic motor.

In particular, the present invention provides a foot plate for a golf swing practice apparatus, wherein with the use of the inventions disclosed in Korean Patent No. 10-0359929 (entitled "Immersive Golf Demonstration System") and Korean Patent Laid-Open Publication No. 2002-0092266 (entitled "Hybrid Golf System and Method of Using the Same") previously filed in the name of the present applicant, the slope of the foot plate can be automatically controlled by a control box installed at the foot plate in such a manner that when a user hits a golf ball on the foot plate of the golf practice apparatus, a computer measures the position (point) to which the ball flies, then detects the slope of the position and transmits a signal to the control box.

BEST MODE FOR CARRYING OUT THE INVENTION

Prior to a description of the slope controllable foot plate of the present invention, a golf demonstration system disclosed in Korean Patent No. 10-0359929 previously filed in the name of the present applicant will be described as an example to which the present invention is applicable.

Figure 1:
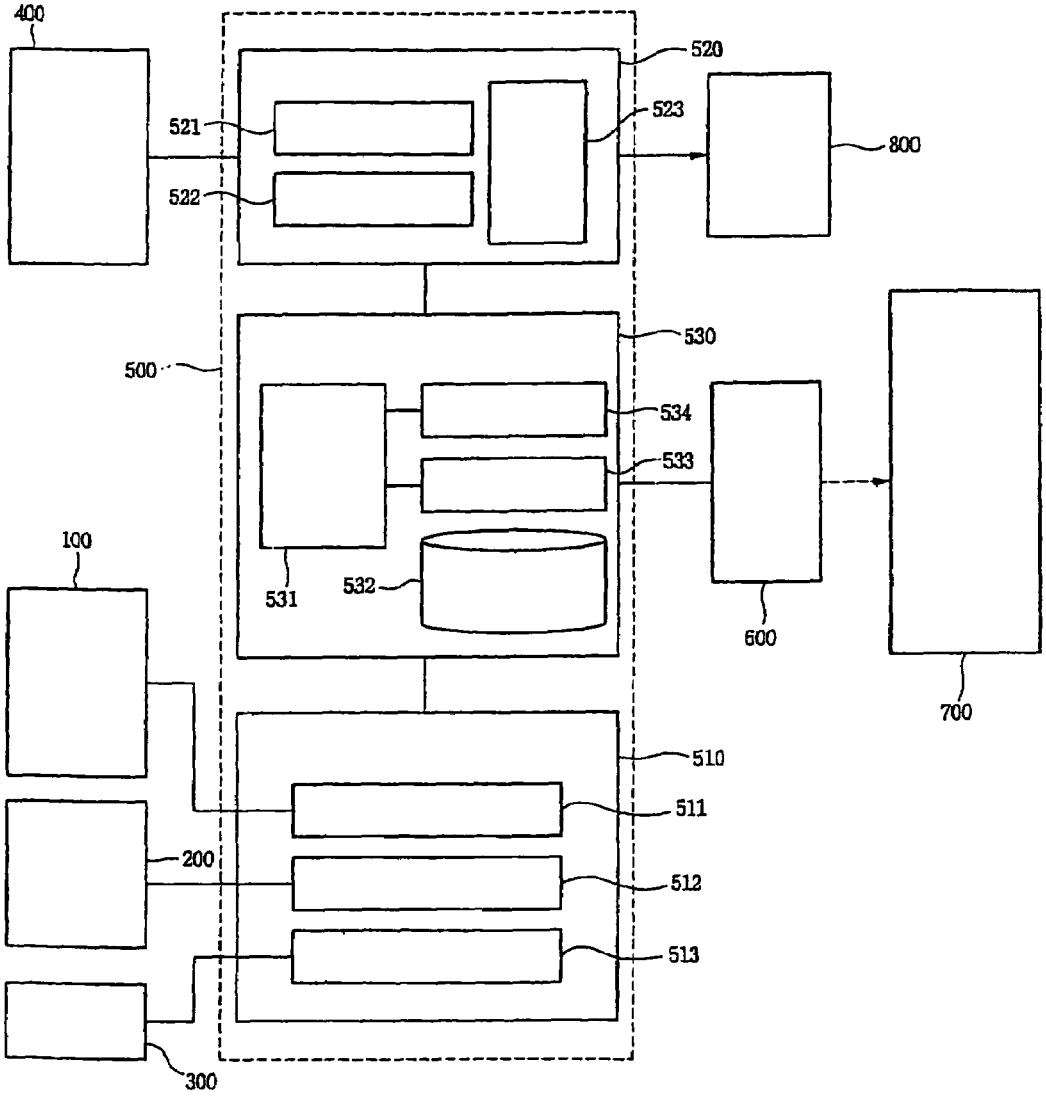
FIG. 1 PRIOR ART
FIG. 1 is a view showing a configuration of an immersive golf demonstration system to which the present invention is applicable.
Figure 2:
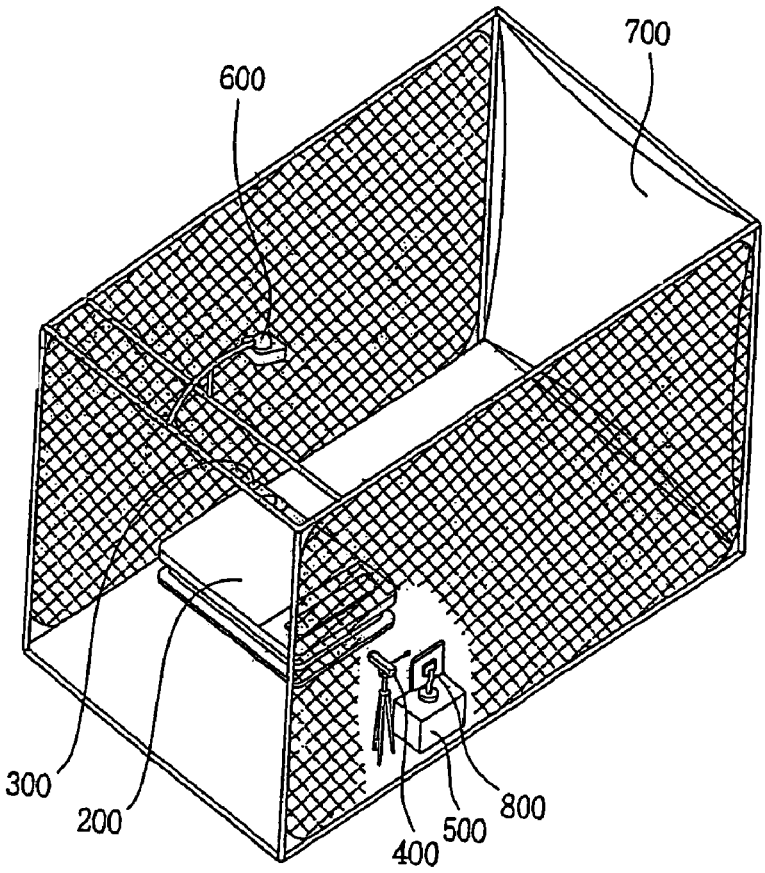
FIG. 2 PRIOR ART
FIG. 2 is a view showing an installed state of the immersive golf demonstration system to which the present invention can be applied.

As shown in FIG. 1, the golf demonstration system disclosed in Korean Patent No. 10-0359929 comprises a swing plate 200 on which a golfer hits a golf ball, a sensor unit 100 for sensing the directions and speeds of a golf club swung by the golfer and the golf ball hit by the golf club, a keypad 300 provided to allow the golfer to select a golf environment, a video unit 400 for recording the golfer's swing motion, a screen unit 700 on which images of a golf course and movement of the golf ball are displayed, a projector 600 for projecting images of a background of the golf course and the movement of the golf ball onto the screen unit 700, an analyzed image output unit 800 for displaying images that analyze the golfer's swing, and a computer processing unit 500 for controlling the respective units to display images of a flying trajectory of the ball based on the flying direction and speed of the golf ball transmitted from the sensor unit 100 and images of a realistic golf course associated with the flying trajectory on the screen unit 700 through the projector 600 and to display the analyzed images for the golfer's swing on the analyzed image output unit 800.

When the swing plate 200 is replaced with the foot plate A for golf practice according to the present invention in the golf demonstration system (Korean Patent No. 10-0359929) and a golfer hits a golf ball with a golf club on the foot plate so as to perform hitting or putting of the golf ball, the sensor unit 100 measures the flying direction and speed of the ball and the computer processing unit 500 then controls the slope of the foot plate. The computer processing unit 500 controls the slope of the foot plate such that it conforms to the environment of a golf course displayed on the screen unit 700, i.e. the topography of the ground where the golf ball is placed.

The foot plate of the present invention is directed to a foot plate for golf practice, wherein upon control of the slope of the foot plate, a control box installed at a side of a support plate senses a signal transmitted from a swing plate controller 512 and controls operations of longitudinal and transverse actuating hydraulic motors installed at front and rear portions of the support plate to regulate oil pressure of longitudinal and transverse actuating hydraulic cylinders and thence oil pressure of front, rear, left and right slope control hydraulic cylinders for controlling the slope of a slope control plate, thereby controlling the slope of the slope control plate.

More specifically, the sensor unit 100 comprises a plurality of sensors for measuring the speed and angle of a golf club swung by a golfer and the speed and angle of a golf ball hit with the golf club and transmits the measured values to the computer processing unit 500. The sensor unit 100 comprises light emitting sensors and light receiving sensors and is disposed at an upper portion of the interior of the foot plate A to prevent interference with light and to accurately sense the directions and speeds upon swing and putting of the golfer.

The keypad 300 is an input unit for allowing the golfer to select a golf environment and provides functions of configuring a variety of realistic golf environments such as selection of a background of a golf course to be displayed on the screen unit 700 and a golf club. The keypad further provides a selection function of allowing the golfer to record his/her own golf practice and store it in a CD-ROM or the like. The keypad 300 is disposed at a side of the top of the foot plate A so as not to hinder the golfer's swing.

The video unit 400 comprises a camcorder for recording the golfer's swing motion for hitting a golf ball. The recording process of the video unit 400 is controlled in response to control signals from the computer processing unit 500, and images recorded by the video unit 400 are transmitted to the computer processing unit 500. The video unit 400 may comprise one or more camcorders for recording the golfer's swing motion. In case of the plurality of camcorders, the images are processed by the computer processing unit 500 to enable many-sided analysis of the golfer's swing motion. Therefore, for the many-sided analysis of the golfer's swing motion, it is preferred that the camcorders of the video unit 400 be installed at front, sides and top of the golfer. Further, for easy image processing, it is preferred that the camcorders of the video unit 400 comprise digital camcorders. However, they may comprise other types of video cameras.

The computer processing unit 500 is a computer system generally comprising hardware such as a main memory, a central processing unit, input/output devices and an auxiliary memory, and software such as an operating system. In an embodiment of the present invention, the computer processing unit 500 comprises a microcomputer 510, a sub computer 520 and a main computer 530, which may be implemented to be incorporated into a single computer or to be connected to one another over a network to construct a distributed computer system.

The microcomputer 510 comprises a sensor board 511 for converting the swing speed and angle of a golf club and the flying speed and angle of a golf ball hit with the golf club, which are sensed by the sensor unit 100, into numerical data and transmitting the data to the main computer 530; a swing plate control section 512 for controlling the slope of the swing plate 200 in response to control signals transmitted from the main computer 530; and a keypad control section 513 for receiving data input from the keypad 300 according to selection of the golfer and transmitting the data to the main computer 530.

The sub computer 520 comprises an image analysis section 522 for receiving and analyzing swing images recorded by the video unit 400; a hit ball analysis section 521 for analyzing the ball hit by the golfer; and an analyzed image output control section 523 for displaying information on the hit ball and the swing on the analyzed image output unit 800.

The hit ball analysis section 521 analyzes information on the moving speeds and angles of the golf club and the golf ball, which have been sensed by the sensor board 511 of the microcomputer 510 and transmitted through the main computer 530, using trajectory equations, projectile motion equations and the like, thereby calculating a moving path, a carry distance and a landing position of the golf ball. Analysis information on the hit ball analyzed through the hit ball analysis section 521 is transmitted back to the main computer 530 and further to the analyzed image output control section 523.

The image analysis section 522 analyzes the golfer's swing motion transmitted through the video unit 400. The analysis of the golfer's swing motion is performed based on a distribution state of golfer's weight among the vertebrae and legs of the golfer according to the golfer's swing motion transmitted from the video unit 400. The analyzed image output control section 523 performs control such that images corresponding to the analysis information on the hit ball and the swing transmitted through the hit ball analysis section 521 and the image analysis section 522 are displayed on the analyzed image output unit 800. The analyzed image output control section 523 allows the golfer to easily understand problems with his/her own swing motion by simultaneously displaying analysis images of the golfer's swing and the hit ball as split pictures on a screen of the analyzed image output unit 800.

The main computer 530 comprises a central control section 531 for controlling and managing the overall operation of the system; a database 532 in which 3-dimensional images produced by modeling images of actual golf courses are stored; a 3-dimensional image processing engine 533 for editing 3-dimensional realistic images of the golf courses by retrieving backgrounds of the golf courses, which change according to the golf ball and the movement thereof, from the database 532 based on the analysis information on the hit ball transmitted through the hit ball analysis section 521 of the sub computer 520 and by combining the retrieved backgrounds; and an image output control section 534 for causing the 3-dimensional images of the golf courses edited by the 3-dimensional image processing engine 533 to be displayed on the screen unit 700 through the projector 600.

Although the database 532 may be constructed outside the main computer 530 in a state where the database is connected thereto on a network, it is preferred that the database be constructed within the main computer 530 in consideration of a transmission rate of 3-dimensional image data. Further, information on the images of the golfer's swing recorded by the video unit 400 can be stored in the database 532. Previously produced information on images of a professional golfer's swing according to locations of a golf course may also be stored in the database.

The 3-dimensional image processing engine 533 edits the information on the 3-dimensional images of the golf courses in conjunction with the information on the golf ball analyzed by the hit ball analysis section 521 of the sub computer 520. That is, the 3-dimensional image processing engine 533 edits images such that the movement of the golf ball according to the carry distance, angle and speed of the golf ball calculated by the hit ball analysis section 521 is displayed, and at the same time, the environment of the golf courses are changed according to the movement of the golf ball. Information on the edited 3-dimensional images is transmitted to the projector 600 through the image output control section 534, and the projector 600 then projects and displays the 3-dimensional images on the screen unit 700. At this time, since the environment of the golf courses displayed on the screen unit 700 is changed in real time to a moved position of the golf ball, the golfer can feel through the screen unit 700 as if he/she plays golf in actual golf courses. Further, the 3-dimensional image processing engine 533 grasps a slope angle at a landing position of the golf ball calculated by the hit ball analysis section 521 and then transmits information on the slope to the swing plate control section 512 of the microcomputer 510 so that the slope of the swing plate 200 can be controlled.

The central control section 531 serves to control and manage the operations of the respective components so that they can smoothly operates.

The screen unit 700 is a kind of output device on which information on the images of the golf courses and the movement of the golf ball projected by the projector 600 is displayed. Since the screen unit 700 is a portion against which the golf ball hit by the golfer directly collides, it should be constructed to maximally suppress the rebound of the golf ball.

Hereinafter, the processes of producing and processing 3-dimensional image data to be processed by the main computer 530 will be described.

First, topographic features of actual golf courses are grasped to produce 3-dimensional image data on the golf courses. Then, the topography of the golf courses is surveyed through photoreconnaissnace of an airplane. Such an aerial survey is performed by dividing the topography of the gold courses into sectors through actual measurement and recording the topography by sector. Images by sector, which have been recorded through the aerial survey, are combined to complete a single still image.

The completed still image is produced into a 3-dimensional image using a 3-dimensional image production program. At this time, the 3-dimensional image production program produces the still image into the 3-dimensional image with the slopes and topography of the actual golf courses exhibited therein by combining the still image with contours and the like of the actual golf courses. The produced 3-dimensional image is subjected to a process of inspecting the size and file errors of image data through a map editor or the like. The inspected 3-dimensional image is stored in the database 532 of the main computer 530.

The 3-dimensional image stored in the database 532 is edited by the 3-dimensional image processing engine 533, and the edited image is transmitted to the projector 600 through the image output control section 534. The projector 600 projects the image on the screen unit 700 so that the image can be displayed thereon. At this time, the 3-dimensional image processing engine 533 moves a visual point of a camera under a 3-dimensional environment and exhibits effects such as the rebound and rolling of the golf ball at a landing position when the golf ball falls on the ground. That is, although images stored as a single piece of data can merely perform the function of showing one picture, the introduction of the image data into the 3-dimensional image processing engine 533 enables display of an interactive moving picture.

Now, a case where golf swing practice is actually done will be described.

First, a golfer that enters a golf range equipped with the golf demonstration system configures an environment of a golf course. The golfer manipulates the keypad 300 provided on the top of the swing plate 200 to select a golf club and a background of the golf course into which an actual golf course has been produced as a 3-dimensional image. Then, images of the environment of the golf course selected by the golfer are displayed on the screen unit 700.

The initial slope of the foot plate A is set up according to the configuration of the environment of the golf course. That is, the 3-dimensional image processing engine 533 of the main computer 530 edits a 3-dimensional image initial picture of the golf course which in turn will be displayed on the screen unit 700. At the same time, the slope of he foot plate A is controlled through the swing plate control section 512 by grasping the slope at a tee shot position for a golf ball. The camcorders of the video unit 400 are operated to record a golfer's swing motion.

When the golfer hits the golf ball placed on the foot plate A, the sensor unit 100 senses the moving angle and speed of the hit golf ball, and sensed information on the hit golf ball is transmitted to the hit ball analysis section 521 of the sub computer 520 through the main computer 530. The hit ball analysis section 521 calculates flying trajectory information of the golf ball, such as the carry distance, angle, speed and landing position and the like thereof.

Then, the golfer's wing motion through which the golf ball is hit is analyzed. Upon analysis of the golfer's swing motion, images of the golfer's swing recorded by the video unit 400 are transmitted to the image analysis section 522 of the sub computer 520, the image analysis section 522 analyzes a distribution state of the golfer's weight and the like according to respective motions during the golfer's swing, and the analyzed information is stored in the database 532.

The information on the hit ball analyzed by the hit ball analysis section 521 is transmitted to the 3-dimensional image processing engine 533 of the main computer 530, and the 3-dimensional image processing engine 533 retrieves and edits relevant 3-dimensional image data stored in the database 532 based on the analyzed information on the hit ball. The retrieval and edit of the image data is performed by continuously retrieving and editing relevant image information according to the flying trajectory of the golf ball.

The edited images of the golf ball and the backgrounds of the golf courses corresponding to the movement of the golf ball are transmitted to the projector 600 through the image output control section 534, and the projector 600 causes the transmitted images to be displayed on the screen unit 700. Therefore, images in which the flying path of the golf ball and the surrounding environments of the golf courses corresponding to the flying path are continuously changed, i.e. 3-dimensional moving pictures, are displayed on the screen unit 700. When the flight of the golf ball is completed and lands and stops at a green of the golf courses, the 3-dimensional image processing engine 533 grasps the degree of inclination of the ground at which the golf ball lands.

The analyzed information on the hit ball and the swing motion is displayed on the analyzed image output unit 800 under the control of the analyzed image output control section 523. This information on the hit ball and the swing motion is graphically processed and displayed so that the golfer can easily understand the information. At this time, a professional golfer' swing motion together with the present golfer's swing motion is displayed on the analyzed image output unit 800, so that the golfer can easily understand problems with his/her own swing motion. As for the professional golfer's swing motion, information on a professional golfer's swing motion at a position identical with or similar to a position where the present golfer swings is retrieved from information previously stored in the database 532 and then displayed.

The grasped information on the degree of inclination of the ground is transmitted to the swing plate control section 512 of the microcomputer 510, and the swing plate control section 512 controls the slope of the foot plate A based on the transmitted degree of inclination.

Figure 3:
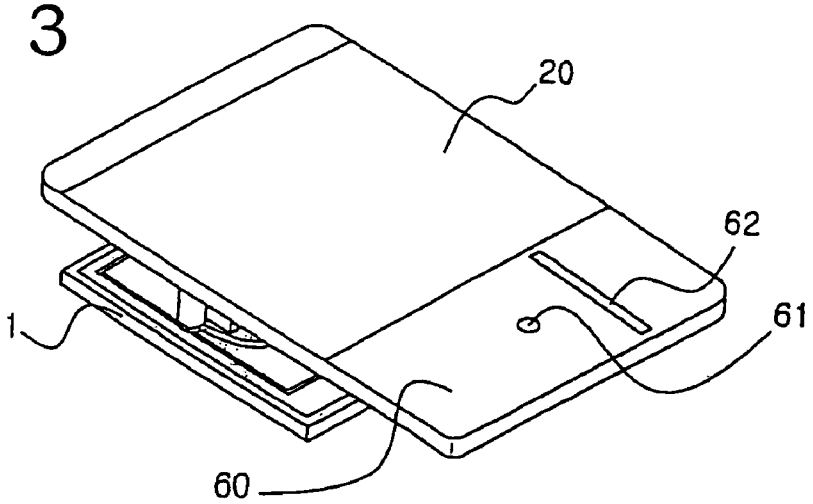
FIG. 3 is a perspective view of a foot plate for a golf swing practice apparatus according to the present invention.
Figure 4:
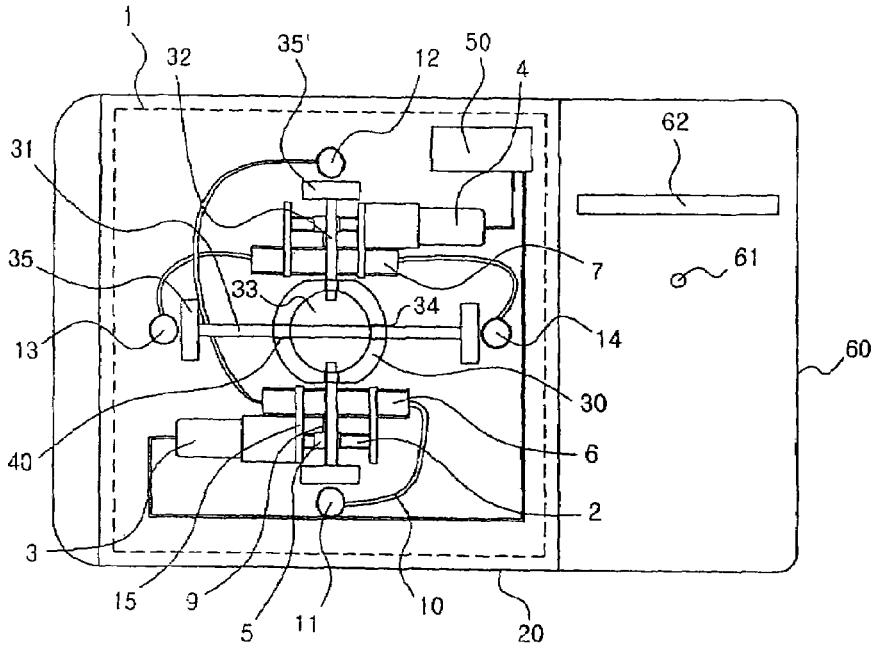
FIG. 4 is a plan view specifically showing the foot plate for the golf swing practice apparatus according to the present invention.
Figure 5:
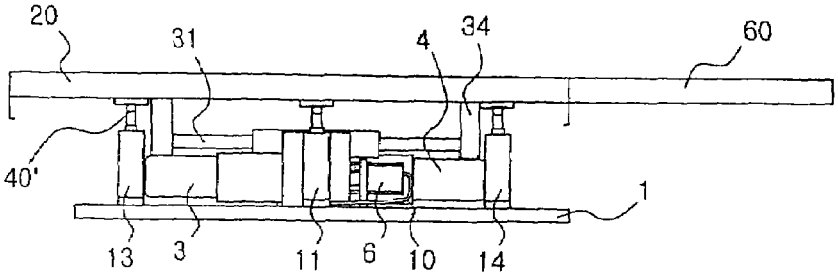
FIG. 5 is a side view specifically showing the foot plate for the golf swing practice apparatus according to the present invention.
Figure 6:
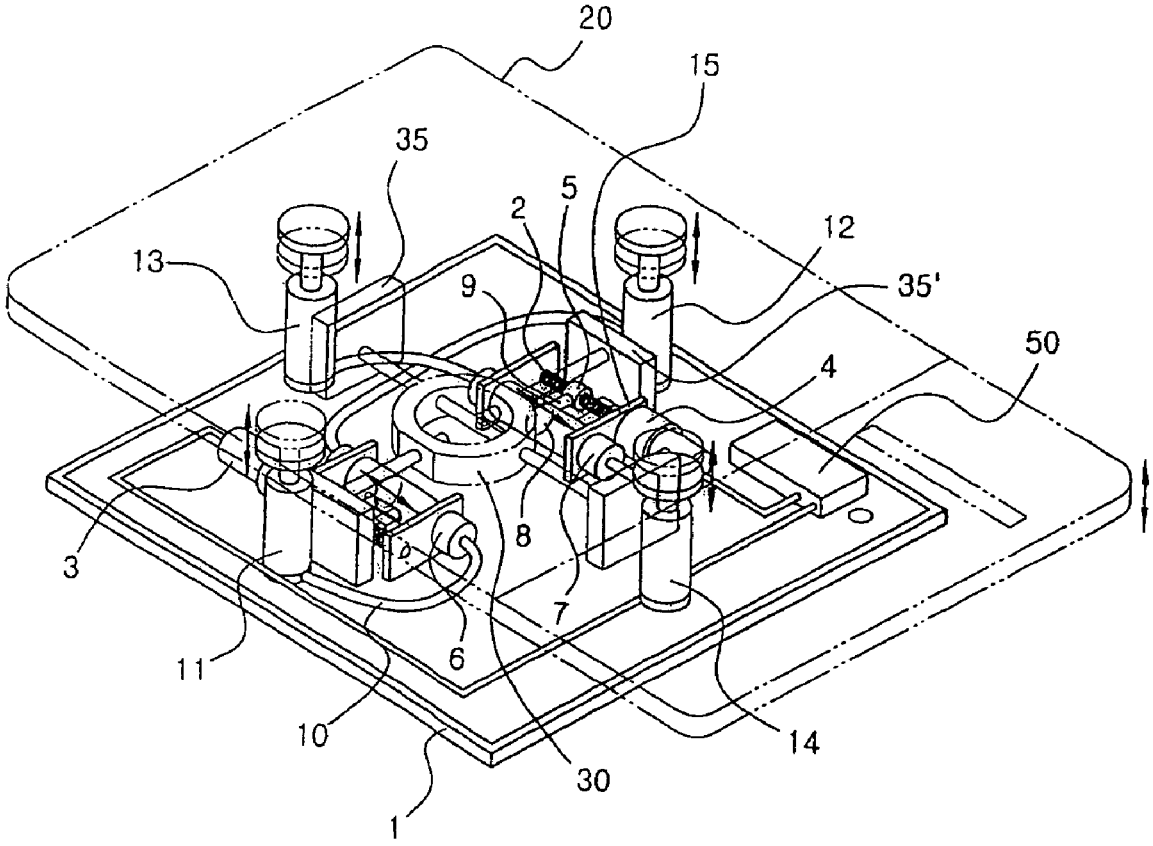
FIG. 6 is a view showing a use state of the foot plate for the golf swing practice apparatus according to the present invention.

Next, the foot plate A for golf practice according to the present invention will be described in detail with reference to FIGS. 3 to 5.

The foot plate A for golf practice according to the present invention comprises a support plate 1; a control box 50 installed at a side of an upper surface of the support plate 1; longitudinal and transverse actuating hydraulic motors 3 and 4 installed at front and rear portions of the upper surface of the support plate 1 and formed with screw shafts 2 of which operations are controlled by the control box 50; longitudinal and transverse hydraulic cylinders 6 and 7 fixedly connected through connection members 15 at one side of the longitudinal and transverse actuating hydraulic motors 3 and 4; an oil pressure regulating unit 8 connected through connection shafts 9 to screw bolts 5, which are fastened to the screw shafts 2 of the longitudinal and transverse actuating hydraulic motors 3 and 4, and provided within the longitudinal and transverse hydraulic cylinders 6 and 7; front, rear, left and right slope control hydraulic cylinders 11, 12, 13 and 14 formed at four sides of the support plate 1 to be connected to a slope control plate 20 and to be lifted and lowered by receiving oil pressure from the longitudinal and transverse hydraulic cylinders 6 and 7 through hydraulic hoses 10 provided at both sides of each of the longitudinal and transverse hydraulic cylinders 6 and 7; the slope control plate 20 provided at the tops of the front, rear, left and right slope control hydraulic cylinders 11, 12, 13 and 14; a reinforcing block 30 formed at the center between the support plate 1 and the slope control plate 20, formed with a space portion 30 therein, and formed with through-holes 34 at front, rear, left and right sides thereof; and upper and lower plate reinforcing bars 31 and 32 inserted into the through-holes 34 of the reinforcing block 30 and connected through upper and lower plate connecting members 35 and 35' to the upper surface of the support plate 1 and a lower surface of the slope control plate 20. Connections of the upper and lower plate reinforcing bars 31 and 32 to the reinforcing block 30 and connections of the front, rear, left and right slope control hydraulic cylinders 11, 12, 13 and 14 to the slope control plate 2 are provided with bearings 40 and 40' to smoothly control the slope of the slope control plate 20. An extension 60 formed with a tee insertion hole 61 and a sensor mounting portion 62 is provided at a right side of the slope control plate 20.

Now, a description of how the swing plate control section 512 controls the slope of the foot plate A according to the transmitted degree of inclination will be discussed with reference with FIGS. 3 to 6.

Upon control of the slope of the foot plate A through the swing plate control section 512, the control box 50 installed at the foot plate A receives a control signal from the swing plate control section 512 and operates the longitudinal and transverse actuating hydraulic motors 3 and 4 installed at the front and rear portions of the support plate 1 in response to the received control signal. The longitudinal and transverse actuating hydraulic motors 3 and 4 are individually or simultaneously operated under the control of the control box 50 so that they can be rotated in a forward or reverse direction. When the longitudinal and transverse actuating hydraulic motors 3 and 4 are operated, the screw bolts 5 fastened to the screw shafts 2 are moved rightward or leftward according to the rotation directions of the screw shafts 2. As the screw bolts 5 move, the oil pressure regulating units 8 formed within the longitudinal and transverse hydraulic cylinders 6 and 7 connected to the screw bolts 5 through the connection shafts 9 are also moved rightward or leftward to apply oil pressure to the front, rear, left and right slope control hydraulic cylinders 11, 12, 13 and 14, thereby controlling the slope of the slope control plate 20. The slope of the slope control plate 20 is smoothly controlled in a fore and aft direction or in a right and left direction by means of the bearings 40 formed at the upper and lower plate reinforcing bars 31 and 32.

For example, when the golfer hits the golf ball on the slope control plate 20 of the foot plate A and the golf ball stops at a position on a virtual field, the computer processing unit 500 measures the position where the golf ball stops and an inclined angle at the position. If the inclined angle at the position is measured to be 5 degrees left, the swing plate control section 512 transmits a signal to the control box 50 in order to control the slope of the slope control plate 20. The control box 50 analyzes the signal received from the swing plate control section 512 and operates the transverse actuating hydraulic motor 4 for controlling the transverse slope. At this time, in order to lift a left side of the slope control plate 20, the transverse actuating hydraulic motor 4 is rotated in the forward direction to rotate the screw shaft 2 in a forward direction, so that the screw bolt 5 fastened to the screw shaft 2 can be moved leftward. As the screw bolt 5 is moved leftward, the oil pressure regulating unit 8 provided within the transverse actuating hydraulic cylinder 7 for regulating oil pressure and connected through the connection shaft 9 to the screw bolt 5 is also moved leftward together therewith. The oil pressure is transmitted, through the hydraulic hose 10 provided at a left side of the transverse actuating hydraulic cylinder 7, to the left slope control hydraulic cylinder 13 connected to the left side of the slope control plate 20. Thus, the left side of the slope control plate 20 is lifted. At the same time, as the oil pressure regulating unit 8 is moved leftward, oil pressure within the right slope control hydraulic cylinder 14 connected to a right side of the slope control plate 20 is dropped. Thus, the right side of the slope control plate 20 is lowered.

When the slope of the slope control plate 20 becomes 5 degrees left due to such an operation, the control box 50 stops the operation of the transverse actuating hydraulic motor 4. In such a manner, the slope of the slope control plate 20 is controlled.

Meanwhile, if an inclined angle at a position where the golf ball stops is measured to be 5 degrees right through the computer processing unit 500, the swing plate control section 512 transmits a signal to the control box 50 in order to control the slope of the slope control plate 20. The control box 50 analyzes the signal received from the swing plate control section 512 and operates the transverse actuating hydraulic motor 4 for controlling the transverse slope. At this time, in order to lift the right side of the slope control plate 20, the transverse actuating hydraulic motor 4 is rotated in the reverse direction to rotate the screw shaft 2 in a rearward direction, so that the screw bolt 5 fastened to the screw shaft 2 can be moved rightward. As the screw bolt 5 is moved rightward, the oil pressure regulating unit 8 provided within the transverse actuating hydraulic cylinder 7 for regulating oil pressure and connected through the connection shaft 9 to the screw bolt 5 is also moved rightward together therewith. The oil pressure is transmitted, through the hydraulic hose 10 provided at a right side of the transverse actuating hydraulic cylinder 7, to the right slope control hydraulic cylinder 14 connected to the right side of the slope control plate 20. Thus, the right side of the slope control plate 20 is lifted. At the same time, as the oil pressure regulating unit 8 is moved rightward, oil pressure within the left slope control hydraulic cylinder 13 connected to the left side of the slope control plate 20 is dropped. Thus, the left side of the slope control plate 20 is lowered.

When the slope of the slope control plate 20 becomes 5 degrees right due to such an operation, the control box 50 stops the operation of the transverse actuating hydraulic motor 4. In such a manner, the slope of the slope control plate 20 is controlled.

The longitudinal slope of the foot plate A for golf practice according to the present invention is also achieved in the same manner as the foregoing by controlling the longitudinal slope of the slope control plate 20 through the operations of the longitudinal actuating hydraulic motor 3, the longitudinal actuating hydraulic cylinder 6 and the front and rear slope control hydraulic cylinders 11 and 12.

Although the preferred embodiment of the present invention has been described above, the present invention is not limited thereto. It should be noted that various modifications and changes can be made thereto without departing from the sprit of the present invention.

INDUSTRIAL APPLICABILITY

With such a constitution, the foot plate of the present invention is constructed to be a semi-hydraulic and semi-mechanical type. Thus, the height of the product is minimized, thereby preventing a golf club from coming into contact with a ceiling of an indoor golf range. Further, the structure of the product is simplified, thereby minimizing production costs. Moreover, since there is no play between components and less load is produced when a golfer stands on the foot plate and practices golf, there is low possibility that a motor will be damaged.

The invention claimed is:

1. A slope control apparatus of a foot plate for a golf practice apparatus, comprising:

a swing plate control section for receiving slope information and generating a control signal for use in controlling a slope of the foot plate;

longitudinal and transverse actuating motors for providing power for use in controlling longitudinal and transverse slopes of the foot plate under the control of the swing plate control section;

converting devices connected to respective screw shafts of the longitudinal and transverse actuating motors to convert the rotational driving force of the longitudinal and transverse actuating motors into a linear driving force;

longitudinal and transverse actuating hydraulic cylinders of which inner oil pressure at both sides is regulated by means of the linear driving force converted by the converting devices; and slope control hydraulic cylinders for controlling the lifting of front, rear, left and right sides of the foot plate by means of the inner oil pressure at both sides of each of the longitudinal and transverse actuating hydraulic cylinders.

2. The apparatus as claimed in claim 1, wherein the converting devices comprise:

screw bolts fastened to the screw shafts;

connection shafts connected to the screw bolts to convert rotational force of the screw bolts into linear motions; and oil pressure regulating units fastened to the connection shafts to regulate the inner oil pressure at the both sides of each of the longitudinal and transverse actuating hydraulic cylinders.

3. The apparatus as claimed in claim 1 or 2, wherein the slope control apparatus is installed at a lower portion of the foot plate.

4. The apparatus as claimed in claim 3, further comprising:

a reinforcing block installed at the lower portion of the foot plate, formed with a space portion therein, and formed with through-holes at the front, rear, left and right sides thereof.

5. The apparatus as claimed in claim 4, further comprising:

a support plate provided at a lower portion of the slope control apparatus;

a slope control plate provided at the top of the slope control hydraulic cylinders; and upper and lower plate reinforcing bars formed at the center between the support plate and the slope control plate, inserted into the through-holes of the reinforcing block and connected through vertical connecting members to an upper surface of the support plate and a lower surface of the slope control plate.

6. The apparatus as claimed in claim 5, further comprising:

bearings installed at connections of the upper and lower plate reinforcing bars to the reinforcing block and connections of the slope control hydraulic cylinders to the slope control plate to smoothly control the slope of the slope control plate.

7. A golf practice apparatus using the slope control apparatus according to claim 1.

8. A method of controlling the slope of a foot plate for a golf practice apparatus, comprising:

a control signal generation step of receiving slope information and generating a control signal for use in controlling the slope of the foot plate;

a motor driving step of driving longitudinal and transverse actuating motors for providing power for use in controlling longitudinal and transverse slopes of the foot plate in response to the control signal;

a conversion step of converting the rotational driving force in the motor driving step into a linear driving force;

an oil pressure regulation step of regulating the inner oil pressure at both sides of each of longitudinal and transverse actuating hydraulic cylinders by means of the linear driving force converted in the conversion step; and a slope control step of controlling the lifting of front, rear, left and right sides of the foot plate by means of the inner oil pressure at both sides regulated in the oil pressure regulation step.

9. A method of manufacturing a slope control apparatus of a foot plate for a golf practice apparatus, comprising the steps of:

installing a swing plate control section for receiving slope information and generating a control signal for use in controlling a slope of the foot plate;

installing longitudinal and transverse actuating motors, for providing power for use in controlling longitudinal and transverse slopes of the foot plate under the control of the swing plate control section;

installing converting devices connected to respective screw shafts of the longitudinal and transverse actuating motors to convert the rotational driving force of the longitudinal and transverse actuating motors into linear driving force;

installing longitudinal and transverse actuating hydraulic cylinders of which inner oil pressure at both sides is regulated by means of the linear driving force converted by the converting devices; and installing slope control hydraulic cylinders for controlling the lifting of front, rear, left and right sides of the foot plate by means of the inner oil pressure at both sides of each of the longitudinal and transverse actuating hydraulic cylinders.

10. A method of manufacturing a golf practice apparatus using the method of manufacturing the slope control apparatus according to claim 9.

* * * * *